US006356278B1

(12) United States Patent
Stamm et al.

(10) Patent No.: US 6,356,278 B1
(45) Date of Patent: Mar. 12, 2002

(54) METHODS AND SYSTEMS FOR ASYMMETERIC SUPERSAMPLING RASTERIZATION OF IMAGE DATA

(75) Inventors: Beat Stamm, Redmond; Gregory C. Hitchcock, Woodinville; Claude Betrisey, Redmond, all of WA (US)

(73) Assignee: Microsoft Corporation, Redmond, WA (US)

( * ) Notice: Subject to any disclaimer, the term of this patent is extended or adjusted under 35 U.S.C. 154(b) by 0 days.

(21) Appl. No.: 09/546,422

(22) Filed: Apr. 10, 2000

Related U.S. Application Data

(63) Continuation-in-part of application No. 09/168,012, filed on Oct. 7, 1998.

(51) Int. Cl.[7] ..... G09G 5/36

(52) U.S. Cl. ..... 345/611; 345/613; 382/260; 382/266; 382/269; 382/274; 382/275

(58) Field of Search ..... 345/611, 613; 382/260, 266, 269, 274, 275

(56) References Cited

U.S. PATENT DOCUMENTS

| | | | | |
|---|---|---|---|---|
| 4,136,359 | A | 1/1979 | Wozniak | 358/17 |
| 4,217,604 | A | 8/1980 | Wozniak | 358/16 |
| 4,278,972 | A | 7/1981 | Wozniak | 340/703 |
| 5,057,739 | A | 10/1991 | Shimada et al. | 313/477 R |
| 5,122,783 | A | 6/1992 | Bassetti, Jr. | 340/701 |
| 5,254,982 | A | 10/1993 | Feigenblatt et al. | 345/148 |

(List continued on next page.)

FOREIGN PATENT DOCUMENTS

| | | | |
|---|---|---|---|
| EP | 0 435 391 A2 | 7/1991 | G09G/3/20 |
| EP | 0 673 012 A2 | 9/1995 | G09G/3/36 |
| WO | WO 00/21037 | 4/2000 | G06T/11/00 |
| WO | WO 00/67247 | 11/2000 | G09G/5/22 |

OTHER PUBLICATIONS

Abram, G. et al. "Efficient Alias–free Rendering using Bit–masks and Look–Up Tables" *San Francisco*, vol. 19, No. 3, 1985 (pp. 53–59).

Ahumada, A.J. et al. "43.1: A Simple Vision Model for Inhomogeneous Image–Quality Assessment" *1998 SID*.

Barbier, B. "25.1:Multi–Scale Filtering for Image Quality on LCD Matrix Displays" *SID 96 DIGEST*.

Barten, P.G.J. "P–8: Effect of Gamma on Subjective Image Quality" *SID 96 Digest*.

(List continued on next page.)

*Primary Examiner*—Almis R. Jankus
*Assistant Examiner*—Henry N. Tran
(74) *Attorney, Agent, or Firm*—Workman & Nydegger, Seeley

(57) ABSTRACT

Methods and systems are disclosed for utilizing an increased number of samples of image data, coupled with the separately controllable nature of RGB pixel sub-components, to generate images with increased resolution on a display device. such as a liquid crystal display. The methods include scaling, hinting, and scan conversion operations. The scaling operation involves scaling the image data by factors of one in the directions perpendicular and parallel to the RGB striping of the display device. Hinting includes placing the scaled image data on a grid that has grid points defined by the positions of the pixels of the display device, and rounding key points to the nearest full pixel boundary in the direction parallel to the striping and to the nearest fractional increment in the direction perpendicular to the striping. Scan conversion includes scaling the hinted image data by an overscaling factor in the direction perpendicular to the striping. The overscaling factor is equivalent to the denominator of the fractional increments of the grid. Scan conversion also includes generating, for each region of the image data, a number of samples that equals the overscaling factor and mapping spatially different sets of the samples to each of the pixel sub-components.

33 Claims, 11 Drawing Sheets

U.S. PATENT DOCUMENTS

| | | | | | |
|---|---|---|---|---|---|
| 5,298,915 | A | | 3/1994 | Bassetti, Jr. et al. | 345/149 |
| 5,334,996 | A | | 8/1994 | Tanigaki et al. | 345/152 |
| 5,341,153 | A | | 8/1994 | Benzschawel et al. | 345/152 |
| 5,349,451 | A | | 9/1994 | Dethardt | 358/518 |
| 5,450,208 | A | | 9/1995 | Murata | 358/296 |
| 5,467,102 | A | | 11/1995 | Kuno et al. | 345/1 |
| 5,530,804 | A | * | 6/1996 | Edgington et al. | 714/30 |
| 5,543,819 | A | | 8/1996 | Farwell et al. | 345/150 |
| 5,548,305 | A | | 8/1996 | Rupel | 345/150 |
| 5,555,360 | A | | 9/1996 | Kumazaki et al. | 395/143 |
| 5,633,654 | A | | 5/1997 | Kennedy, Jr. et al. | 345/114 |
| 5,689,283 | A | | 11/1997 | Shirochi | 345/132 |
| 5,767,837 | A | | 6/1998 | Hara | 345/152 |
| 5,821,913 | A | | 10/1998 | Mamiya | 345/88 |
| 5,847,698 | A | | 12/1998 | Reavey et al. | 345/173 |
| 5,894,300 | A | | 4/1999 | Takizawa | 345/115 |
| 5,940,080 | A | * | 8/1999 | Ruehle et al. | 345/432 |
| 5,949,643 | A | | 9/1999 | Batio | 361/681 |
| 5,963,185 | A | | 10/1999 | Havel | 345/83 |
| 6,072,500 | A | * | 6/2000 | Foran et al. | 345/431 |
| 6,115,049 | A | * | 9/2000 | Winner et al. | 345/432 |
| 6,188,385 | B1 | * | 2/2001 | Hill et al. | 345/136 |
| 6,219,025 | B1 | * | 4/2001 | Hill et al. | 345/136 |
| 6,243,070 | B1 | * | 6/2001 | Hill et al. | 345/136 |

OTHER PUBLICATIONS

Beck. D.R. "Motion Dithering for Increasing Perceived Image Quality for Low–Resolution Displays" *1998 SID*.

Bedford–Roberts, J. et al. "10.4: Testing the Value of Gray-Scaling for Images of Handwriting" *SID 95 DIGEST*, pp. 125–128.

Chen, L.M. et al. "Visual Resolution Limits for Color Matrix Displays" *Displays—Technology and Applications*, vol. 13, No. 4, 1992, pp. 179–186.

Cordonnier, V. "Antialiasing Characters by Pattern Recognition" *Proceedings of the S.I.D.* vol. 30, No. 1, 1989, pp. 23–28.

Cowan, W. "Chapter 27, Displays for Vision Research" *Handbook of Optics, Fundamentals, Techniques & Design*, Second Edition, vol. 1, pp. 27.1–27.44.

Crow, F.C. "The Use of Grey Scale for Improved Raster Display of Vectors and Characters" *Computer Graphics*, vol. 12, No. 3, Aug. 1978, pp. 1–5.

Feigenblatt, R.I., "Full–color Imaging on amplitude–quantized color mosaic displays" *Digital Image Processing Applications SPIE* vol. 1075 (1989) pp. 199–205.

Gille, J. et al. "Grayscale/Resolution Tradeoff for Text: Model Predictions" *Final Report*, Oct. 1992–Mar. 1995.

Gould, J.D. et al. "Reading From CRT Displays Can Be as Fast as Reading From Paper" *Human Factors*, vol. 29 No. 5, pp. 497–517, Oct. 1987.

Gupta, S. et al. "Anti–Aliasing Characters Displayed by Text Terminals" *IBM Technical Disclosure Bulletin*, May 1983 pp. 6434–6436.

Hara, Z et al. "Picture Quality of Different Pixel Arrangements for Large–Sized Matrix Displays" *Electronics and Communications in Japan*, Part 2, vol. 77, No. 7, 1974, pp. 105–120.

Kajiya, J. et al. "Filtering High Quality Text For Display on Raster Scan Devices" *Computer Graphics*, vol. 15, No. 3, Aug. 1981, pp. 7–15.

Kato, Y. et al. "13:2 A Fourier Analysis of CRT Displays Considering the Mask Structure, Beam Spot Size, and Scan Pattern" (c) *1998 SID*.

Krantz, J. et al. "Color Matrix Display Image Quality: The Effects of Luminance and Spatial Sampling" *SID 90 Digest*, pp. 29–32.

Kubala, K. et al. "27:4: Investigation Into Variable Addressability Image Sensors and Display Systems" *1998 SID*.

Mitchell, D.P. "Generating Antialiased Images at Low Sampling Densities" *Computer Graphics*, vol. 21, No. 4, Jul. 1987, pp. 65–69.

Mitchell, D.P. et al., "Reconstruction Filters in Computer Graphics", *Computer Graphics*, vol. 22, No. 4, Aug. 1988, pp. 221–228.

Morris R.A., et al. "Legibility of Condensed Perceptually –tuned Grayscale Fonts" *Electronic Publishing, Artistic Imaging, and Digital Typography*, Seventh International Conference on Electronic Publishing, Mar. 30–Apr. 3, 1998, pp. 281–293.

Murch, G. et al. "7.1: Resolution and Addressibility: How Much is Enough?" *SID 85 Digest*, pp. 101–103.

Naiman, A., "Some New Ingredients for the Cookbook Approach to Anti–Aliased Text" *Proceedings Graphics Interface 81*, Ottawa, Ontario, May 28—Jun. 1, 1984, pp. 99–108.

Naiman, A, et al. "Rectangular Convolution for Fast Filtering of Characters" *Computer Graphics*, vol. 21, No. 4, Jul. 1987, pp. 233–242.

Naiman, A.C. "10:1 The Visibility of Higher–Level Jags" *SID 95 Digest* pp. 113–116.

Peli, E. "35.4: Luminance and Spatial–Frequency Interaction in the Perception of Contrast", *SID 96 Digest*.

Pringle, A., "Aspects of Quality in the Design and Production of Text", *Association of Computer Machinery* 1979, pp. 63–70.

Rohellec, J. Le et al. "35.2:LCD Legibility Under Different Lighting Conditions as a Function of Character Size and Contrast" *SID 96 Digest*.

Schmandt, C. "Soft Typography" Information Processing 80, *Proceedings of the IFIP Congress* 1980, pp. 1027–1031.

Sheedy, J.E. et al. "Reading Performance and Visual Comfort with Scale to Grey Compared with Black–and–White Scanned Print" *Displays*, vol. 15, No. 1, 1994, pp. 27–30.

Sluyterman, A.A.S. "13:3 A Theoretical Analysis and Empirical Evaluation of the Effects of CRT Mask Structure on Character Readability" (c) *1998 SID*.

Tung. C., "Resolution Enhancement Technology in Hewlett–Packard LaserJet Printers" *Proceedings of the SPIE—The International Society for Optical Engineering*, vol. 1912, pp. 440–448.

Warnock, J.E. "The Display of Characters Using Gray Level Sample Arrays", *Association of Computer Machinery*, 1980, pp. 302–307.

Whitted, T. "Anti–Aliased Line Drawing Using Brush Extrusion" *Computer Graphics*, vol. 17, No. 3, Jul. 1983, pp. 151,156.

Yu, S., et al. "43:3 How Fill Factor Affects Display Image Quality" (c) *1998 SID*.

"Cutting Edge Display Technology—The Diamond Vision Difference" www.amasis.com/diamondvision/technical.html, Jan. 12, 1999.

"Exploring the Effect of Layout on Reading from Screen" http://fontweb/internal/ repository/research/explore.asp?RES×ultra, 10 pages, Jun. 3, 1998.

"How Does Hinting Help?" http://www.microsoft.com/typography/hinting/how.htm/fname×%20&fsize, Jun. 30, 1997.
"Legibility on screen: A report on research into line length, document height and number of columns" http://fontweb/internal/repository/research/ scrnlegi.asp?RES×ultra Jun. 3, 1998.
"The Effect of Line Length and Method of Movement on reading from screen" http://fontweb/internal/repository/research/linelength.asp?RES×ultra, 20 pages, Jun. 3, 1998.
"The Legibility of Screen Formats: Are Three Columns Better Than One?" http://fontweb/internal/repository/research/scrnformat.asp?RES×ultra, 16 pages, Jun. 3, 1998.
"The Raster Tragedy at Low Resolution" http://www.microsoft.com/typography/tools/trtalr.htm?fname× %20&fsize.
"The TrueType Rasterizer" http://www.microsoft.com/typography/what/raster.htm?fname×%20&fsize, Jun. 30, 1997.
"TrueType fundamentals" http://www.microsoft.com/OTSPEC/TTCHO1.htm?fname×%20&fsize× Nov. 16, 1997.
"True Type Hinting" http://www.microsoft.com/typography/hinting/hinting.htm Jun. 30, 1997.
"Typographic Research" http://fontweb/internal/repository/research/research2.asp?RES×ultra Jun. 3, 1998.

* cited by examiner

METHODS AND SYSTEMS FOR ASYMMETERIC SUPERSAMPLING RASTERIZATION OF IMAGE DATA

RELATED APPLICATIONS

This application is a continuation-in-part of U.S. patent application Ser. No. 09/168,012, filed Oct. 7, 1998 and entitled "METHODS AND APPARATUS FOR DISPLAYING IMAGES SUCH AS TEXT," which is incorporated herein by reference.

BACKGROUND OF THE INVENTION

1. The Field of the Invention

The present invention relates to methods and systems for displaying images with increased resolution, and more particularly, to methods and systems that utilize an increased number of sampling points to generate an increased resolution of an image displayed on a display device, such as a liquid crystal display.

2. The Prior State of the Art

With the advent of the information age, individuals worldwide spend substantial amounts of time viewing display devices and thus suffer from problems such as eyestrain. The display devices that are viewed by the individuals display electronic image data, such as text characters. It has been observed that text is more easily read and eyestrain is reduced as the resolution of text characters improves. Thus, achieving high resolution of text and graphics displayed on display devices has become increasingly important.

One such display device that is increasingly popular is a flat panel display device, such as a liquid crystal display (LCD). However, most traditional image processing techniques, including generating and displaying fonts, have been developed and optimized for display on a cathode ray tube (CRT) display rather than for display on an LCD. Furthermore, existing text display routines fail to take into consideration the unique physical characteristics of flat panel display devices, which differ considerably from the characteristics of CRT devices, particularly in regard to the physical characteristics of the light sources of the display devices.

CRT display devices use scanning electron beams that are controlled in an analog manner to activate phosphor positioned on a screen. A pixel of a CRT display device that has been illuminated by the electron beams consists of a triad of dots, each of a different color. The dots included in a pixel are controlled together to generate what is perceived by the user as a single point or region of light having a selected color defined by a particular hue, saturation, and intensity. The individual dots in a pixel of a CRT display device are not separately controllable. Conventional image processing techniques map a single sample of image data to an entire pixel, with the three dots included in the pixel together representing a single portion of the image. CRT display devices have been widely used in combination with desktop personal computers, workstations, and in other computing environments in which portability is not an important consideration.

In contrast to CRT display devices, the pixels of LCD devices, particularly those that are digitally driven, have separately addressable and separately controllable pixel sub-components. For example, a pixel of an LCD display device may have separately controllable red, green, and blue pixel sub-components. Each pixel sub-component of the pixels of an LCD device is a discrete light emitting device that can be individually and digitally controlled. However, LCD display devices have been used in conjunction with image processing techniques originally designed for CRT display devices, such that the separately controllable nature of the pixel sub-components is not utilized. Existing text rendering processes, when applied to LCD display devices, result in each three-part pixel representing a single portion of the image. LCD devices have become widely used in portable or laptop computers due to their size, weight, and relatively low power requirements. Over the years, however, LCD devices have begun to more common in other computing environments, and have become more widely used with non-portable personal computers.

Conventional rendering processes applied to LCD devices are illustrated in FIG. 1, which shows image data 10 being mapped to entire pixels 11 of a region 12 of an LCD device. Image data 10 and portion 12 of the flat panel display device (e.g., LCD device) are depicted as including corresponding rows R(N) through R(N+2) and columns C(N) through C(N+2). Portion 12 of the flat panel display device includes pixels 11, each of which has separately controllable red, green, and blue pixel sub-components.

As part of the mapping operation, a single sample 14 that is representative of the region 15 of image data 10 defined by the intersection of row R(N) and column C(N+1) is mapped to the entire three-part pixel 11A located at the intersection of row R(N) and column C(N+1). The luminous intensity values used to illuminate the R, G, and B pixel sub-components of pixel 11A are generated based on the single sample 14. As a result, the entire pixel 11A represents a single region of the image data, namely, region 15. Although the R, G, and B pixel sub-components are separately controllable, the conventional image rendering process of FIG. 1 does not take advantage of their separately controllable nature, but instead operates them together to display a single color that represents a single region of the image.

Text characters represent one type of image that is particularly difficult to accurately display given typical flat panel display resolutions of 72 or 96 dots (pixels) per inch (dpi). Such display resolutions are far lower than the 600 dpi resolution supported by most printers. Even higher resolutions are found in most commercially printed text such as books and magazines. As such, not enough pixels are available to draw smooth character shapes, especially at common text sizes of 10, 12, and 14 point type. At such common text rendering sizes, portions of the text appear more prominent and coarse on the display device than in their print equivalent It would, therefore, be an advancement in the art to improve the resolution of text and graphics displayed on display devices, particularly on flat panel displays. It would be an advancement in the art to reduce the coarseness of displayed images so that they more closely resemble their print equivalents or the font image data designed by typographers. It would also be desirable for the image processing techniques that provide such improved resolution to take into consideration the unique physical characteristics of flat panel display devices.

SUMMARY OF THE INVENTION

The present invention is directed to methods and systems for displaying images on a flat panel display device, such as a liquid crystal display (LCD). Flat panel display devices use various types of pixel arrangements, such as horizontal or vertical striping, and the present invention can be applied to any of the arrangement alternatives to provide an increased resolution on the display device.

The invention relates to image processing operations whereby individual pixel sub-components of a flat panel display device are separately controlled and represent different portions of an image, rather than the entire pixel representing a single portion of the image. Unlike conventional image processing techniques, the image processing operations of the invention take advantage of the separately controllable nature of pixel sub-components in LCD display devices. As a result, text and graphics rendered according to the invention have improved resolution and readability.

The invention is described herein primarily in the context of rendering text characters, although the invention also extends to processing image data representing graphics and the like. Text characters defined geometrically by a set of points, lines, and curves that represent the outline of the character represent an example of the types of image data that can be processed according to the invention.

The general image processing operation of the invention includes a scaling operation, a hinting operation and a scan conversion operation that are performed on the image data. Although the scaling operation and the hinting operation are performed prior to the scan conversion operation, the following discussion will be first directed to scan conversion to introduce basic concepts that will facilitate an understanding of the other operations, namely, a supersampling rate and an overscaling factor.

In order to enable each of the pixel sub-components of a pixel to represent a different portion of the image, the scaled and hinted image data is supersampled in the scan conversion operation. The data is "supersampled" in the sense that more samples of the image data are generated than would be required in conventional image processing techniques. When the pixels of the display device have three pixel sub-components, the image data will be used to generate at least three samples in each region of the image data that corresponds to an entire pixel. Often, the supersampling rate, or the number of samples generated in the supersampling operation for each region of the image data that corresponds to an entire pixel, is greater than three. The number of samples depends on weighting factors that are used to map the samples to individual pixel sub-components as will be described in greater detail herein. For instance, the image data can be sampled at a supersampling rate of 10, 16, 20 or any other desired number of samples per pixel-sized region of the image data. In general, greater resolution of the displayed image can be obtained as the supersampling rate is increased and approaches the resolution of the image data. The samples are then mapped to pixel sub-components to generate a bitmap later used in displaying the image on the display device In order to facilitate the supersampling, the image data that is to be supersampled is overscaled in the direction perpendicular to the striping of the display device as part of the scan conversion operation. The overscaling is performed using an overscaling factor that is equal to the supersampling rate, or the number of samples to be generated for each region of the image data that corresponds to a full pixel.

The image data that is subjected to the scan conversion operation as described above is first processed in the scaling operation and the hinting operation. The scaling operation can be trivial, with the image data being scaled by a factor of one in the directions perpendicular and parallel to the striping. In such trivial instances the scaling factor can be omitted. Alternatively, the scaling factor can be non-trivial, with the image data being scaled in both directions perpendicular and parallel to the striping by a factor other than one, or with the image data being scaled by one factor in the direction perpendicular to the striping and by a different factor in the direction parallel to the striping.

The hinting operation involves superimposing the scaled image data onto a grid having grid points defined by the positions of the pixels of the display device and adjusting the position of key points on the image data (i.e., points on a character outline) with respect to the grid. The key points are rounded to grid points that have fractional positions on the grid. The grid points are fractional in the sense that they can fall on the grid at locations other than full pixel boundaries. The denominator of the fractional position is equal to the overscaling factor that is used in the scan conversion operation described above. In other words, the number of grid positions in a particular pixel-sized region of the grid to which the key points can be adjusted is equal to the overscaling factor. If the supersampling rate and the overscaling factor of the scan conversion process is 16, the image data is adjusted to grid points having fractional positions of $1/16_{th}$ of a pixel in the hinting operation. The hinted image data is then available to be processed in the scan conversion operation described above.

The foregoing scaling, hinting and scan conversion operations enable image data to be displayed at a higher resolution on a flat panel display device, such as an LCD, compared to prior art image rendering processes. Each pixel sub-component represents a spatially different region of the image data, rather than entire pixels representing single regions of the image.

Additional features and advantages of the invention will be set forth in the description that follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order that the manner in which the above recited and other advantages and features of the invention are obtained, a more particular description of the invention briefly described above will be rendered by reference to specific embodiments thereof that are illustrated in the appended drawings. Understanding that these drawing depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The present invention relates to both methods and systems for displaying image data with increased resolution by taking advantage of the separately controllable nature of pixel sub-components in flat panel displays. Each of the pixel sub-components has mapped thereto a spatially distinct set of one or more samples of the image data. As a result, each of the pixel sub-components represents a different portion of the image, rather than an entire pixel representing a single portion of the image.

The invention is directed to the image processing techniques that are used to generate the high-resolution displayed image. In accordance with the present invention, scaled and hinted image data is supersampled to obtain the samples that are mapped to individual pixel sub-components. In preparation for the supersampling, the image data is hinted, or fitted to a grid representing the pixels and pixel sub-components of the display device, and selected key points of the image data are adjusted to grid points having fractional positions with respect to pixel boundaries.

In order to facilitate the disclosure of the present invention and corresponding preferred embodiments, the ensuing description is divided into subsections that focus on exemplary computing and hardware environments, image data processing and image rendering operations, and exemplary software embodiments.

I. Exemplary Computing and Hardware Environments

Embodiments of the present invention can comprise a special-purpose or general-purpose computer including various computer hardware components, as discussed in greater detail below. Embodiments within the scope of the present invention can also include computer-readable media for carrying or having computer-executable instructions or data structures stored thereon. Such computer-readable media is any available media that can be accessed by a general-purpose or special-purpose computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code means in the form of computer-executable instructions or data structures and which can be accessed by a general-purpose or special-purpose computer. When information is transferred or provided over a network or another communications connection (either hardwired, wireless, or a combination of hardwired or wireless) to a computer, the computer properly views the connection as a computer-readable medium. Thus, any such a connection is properly termed a computer-readable medium. Combinations of the above should also be included within the scope of computer-readable media. Computer-executable instructions comprise, for example, instructions and data that cause a general-purpose computer, special-purpose computer, or special-purpose processing device to perform a certain function or group of functions.

Figure 1:
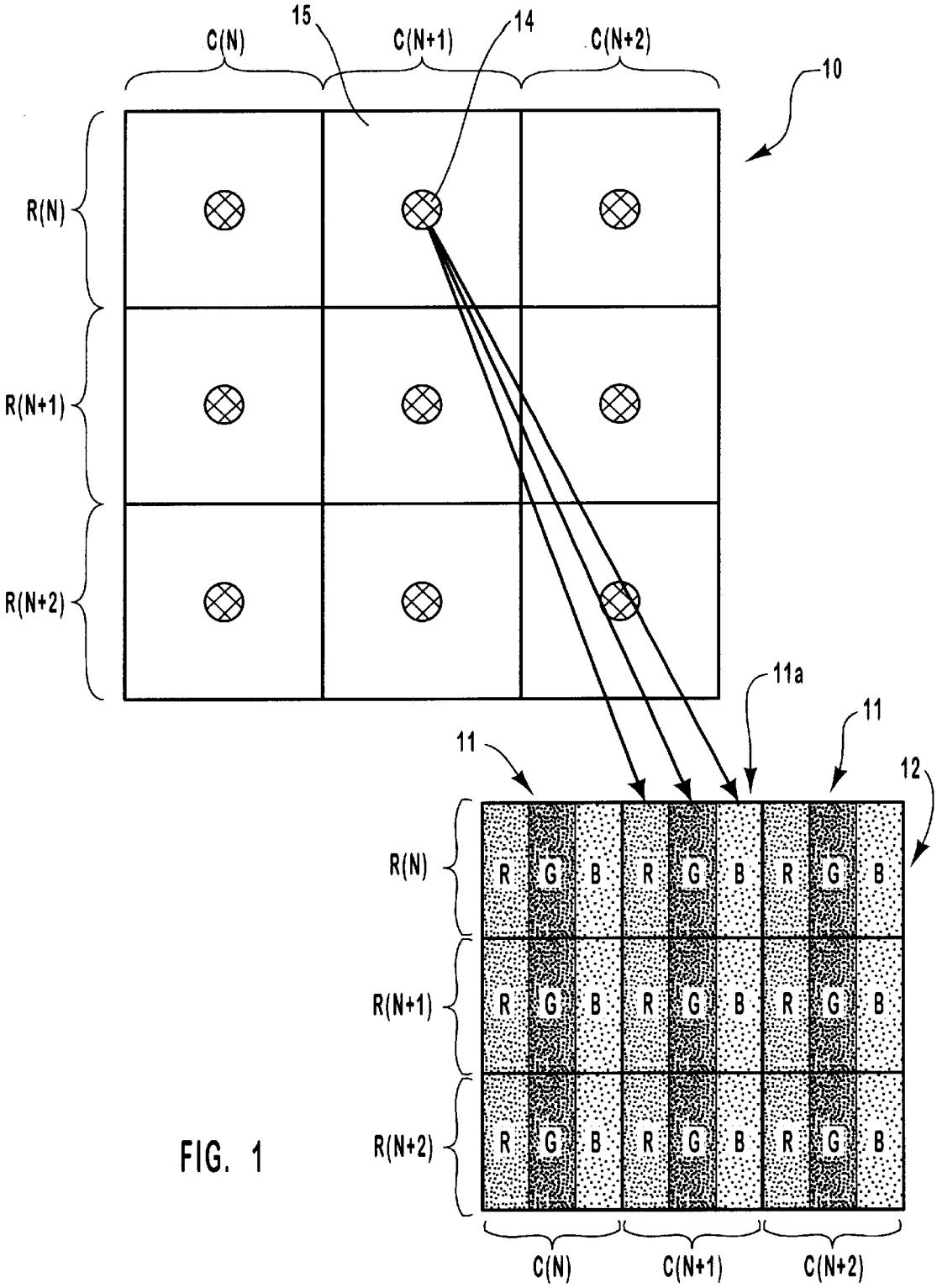
FIG. 1 illustrates a conventional image rendering process whereby entire pixels represent single regions of an image.
Figure 2:
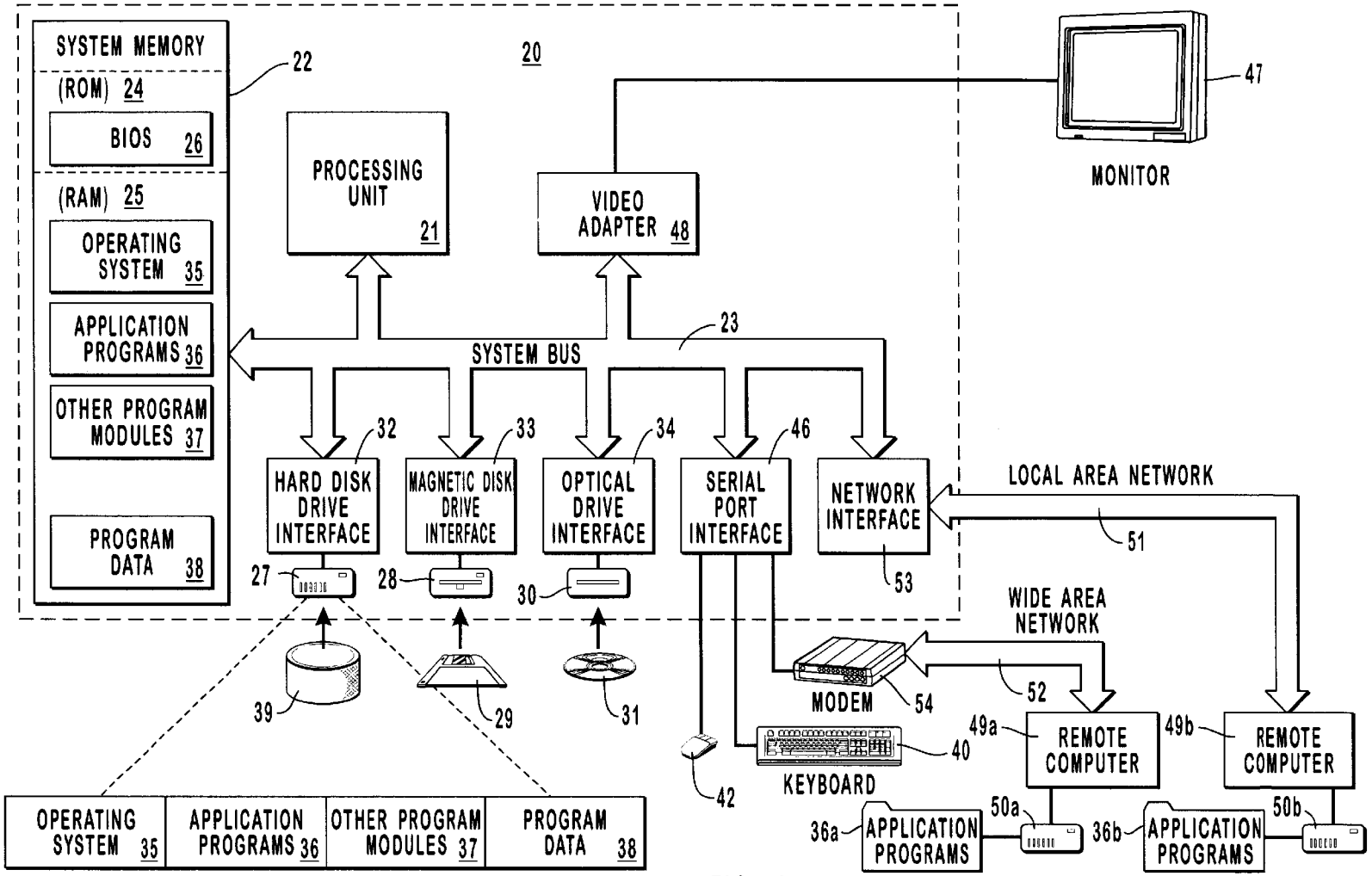
FIG. 2 illustrates an exemplary system that provides a suitable operating environment for the present invention.

FIG. 2 and the following discussion are intended to provide a brief, general description of a suitable computing environment in which the invention may be implemented. Although not required, the invention will be described in the general context of computer-executable instructions, such as program modules, being executed by one or more computers. Generally, program modules include routines, programs, objects,components, data structures, and so forth, that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described in such steps.

Those skilled in the art will appreciate that the present invention may be practiced in network computing environments with many types of computer system configurations, including personal computers, hand-held devices, multiprocessor systems, microprocessor-based or programmable consumer electronics, network PCs, minicomputers, mainframe computers, and the like. The invention may also be practiced in distributed computing environments where tasks are performed by local and remote processing devices that are linked (either by hardwired links, wireless links, or by a combination of hardwired or wireless links) through a communications network. In a distributed computing environment, program modules may be located in both local and remote memory storage devices.

With reference to FIG. 2, an exemplary system for implementing the invention includes a general-purpose computing device in the form of a conventional computer 20, including a processing unit 21, a system memory 22, and a system bus 23 that couples various system components including the system memory 22 to the processing unit 21. The system bus 23 may be any of several types of bus structures including a memory bus or memory controller, a peripheral bus, and a local bus using any of a variety of bus architectures. The system memory includes read only memory (ROM) 24 and random access memory (RAM) 25. A basic input/output system (BIOS) 26, containing the basic routines that help transfer information between elements within the computer 20, such as during start-up, may be stored in ROM 24.

The computer 20 may also include a magnetic hard disk drive 27 for reading from and writing to a magnetic hard disk 39, a magnetic disk drive 28 for reading from or writing to a removable magnetic disk 29, and an optical disk drive 30 for reading from or writing to removable optical disk 31 such as a CD-ROM or other optical media. The magnetic hard disk drive 27, magnetic disk drive 28, and optical disk drive 30 are connected to the system bus 23 by a hard disk drive interface 32, a magnetic disk drive-interface 33, and an optical drive interface 34, respectively. The drives and their associated computer-readable media provide nonvolatile storage of computer-executable instructions, data structures, program modules and other data for computer 20. Although the exemplary environment described herein employs a magnetic hard disk 39, a removable magnetic disk 29 and a removable optical disk 31, other types of computer readable media for storing data can be used, including magnetic cassettes, flash memory cards, digital video disks, Bernoulli cartridges, RAMs, ROMs, and the like.

Program code means comprising one or more program modules may be stored on the hard disk 39, magnetic disk 29, optical disk 31, ROM 24 or RAM 25, including an operating system 35, one or more application programs 36, other program modules 37, and program data 38. A user may enter commands and information into the computer 20 through keyboard 40, pointing device 42, or other input devices (not shown), such as a microphone, joy stick, game pad, satellite dish, scanner, or the like. These and other input devices are often connected to the processing unit 21 through a serial port interface 46 coupled to system bus 23. Alternatively, the input devices may be connected by other interfaces, such as a parallel port, a game port or a universal serial bus (USB). A monitor 47, which can be a flat panel display device or another type of display device, is also connected to system bus 23 via an interface, such as video adapter 48. In addition to the monitor, personal computers typically include other peripheral output devices (not shown), such as speakers and printers.

The computer 20 may operate in a networked environment using logical connections to one or more remote computers, such as remote computers 49*a* and 49*b*. Remote computers 49*a* and 49*b* may each be another personal computer, a server, a router, a network PC, a peer device or other common network node, and typically includes many or all of the elements described above relative to the computer 20, although only memory storage devices 50*a* and 50*b* and their associated application programs 36*a* and 36*b* have been illustrated in FIG. 2. The logical connections depicted in FIG. 2 include a local area network (LAN) 51 and a wide area network (WAN) 52 that are presented here by way of example and not limitation. Such networking environments are commonplace in office-wide or enterprise-wide computer networks, intranets and the Internet.

When used in a LAN networking environment, the computer 20 is connected to the local network 51 through a network interface or adapter 53. When used in a WAN networking environment, the computer 20 may include a modem 54, a wireless link, or other means for establishing communications over the wide area network 52, such as the Internet. The modem 54, which may be internal or external, is connected to the system bus 23 via the serial port interface 46. In a networked environment, program modules depicted relative to the computer 20, or portions thereof, may be stored in the remote memory storage device. It will be appreciated that the network connections shown are exemplary and other means of establishing communications over wide area network 52 may be used.

As explained above, the present invention may be practiced in computing environments that include many types of computer system configurations, such as personal computers, hand-held devices, multi-processor systems, microprocessor-based or programmable consumer electronics, network PCs, minicomputers, mainframe computers, and the like. One such exemplary computer system configuration is illustrated in FIG. 3 as portable computer 60, which includes magnetic disk drive 28, optical disk drive 30 and corresponding removable optical disk 31, keyboard 40, monitor 47, pointing device 62 and housing 64.

Figure 3:
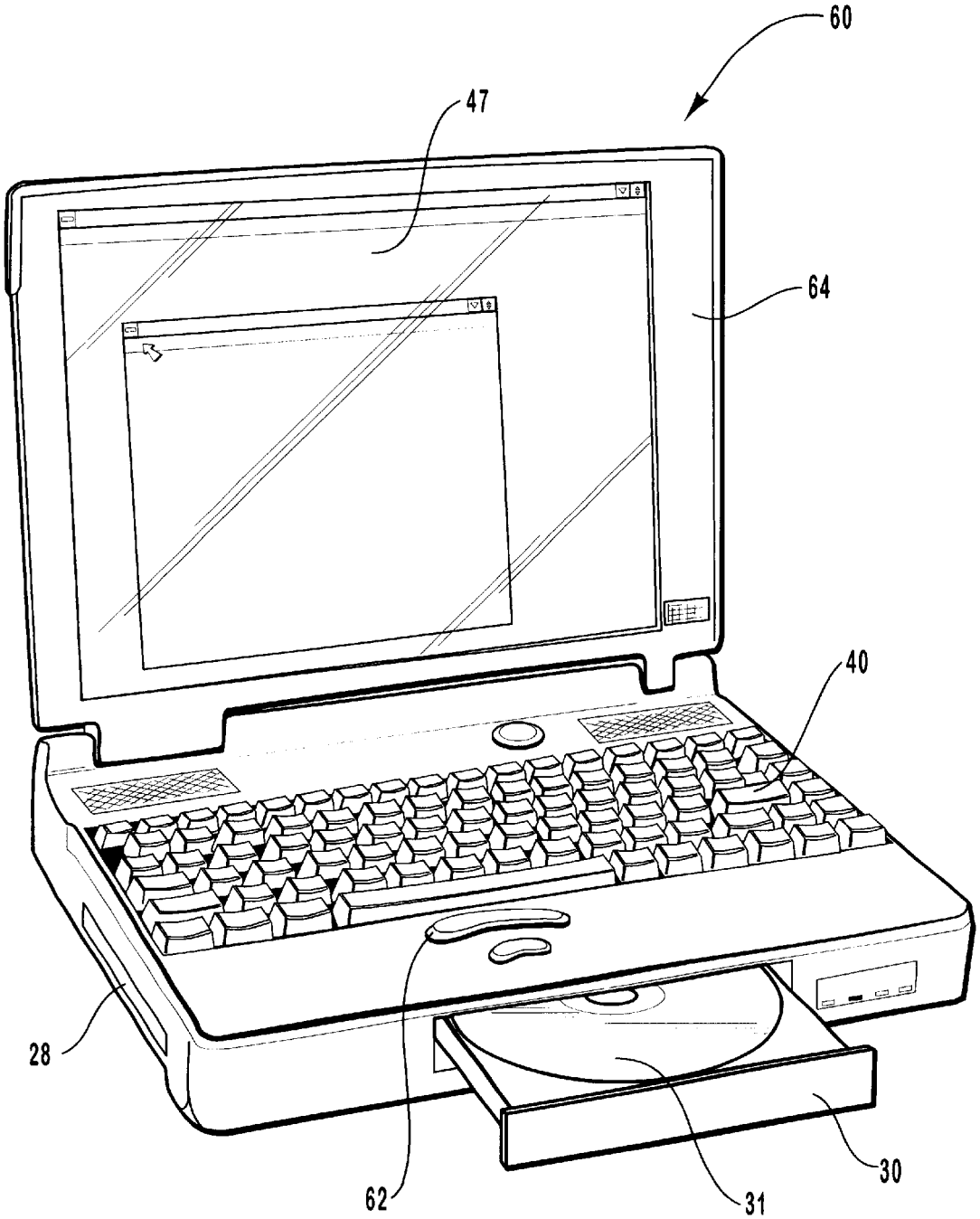
FIG. 3 provides an exemplary computer system configuration having a flat panel display device.

Portable personal computers, such as portable computer 60, tend to use flat panel display devices for displaying image data, as illustrated in FIG. 3 by monitor 47. One example of a flat panel display device is a liquid crystal display (LCD). Flat panel display devices tend to be small and lightweight as compared to other display devices, such as cathode ray tube (CRT) displays. In addition, flat panel display devices tend to consume less power than comparable sized CRT displays making them better suited for battery powered applications. Thus, flat panel display devices are becoming ever more popular. As their quality continues to increase and their cost continues to decrease, flat panel displays are also beginning to replace CRT displays in desktop applications.

The invention can be practiced with substantially any LCD or other flat panel display device that has separately controllable pixel sub-components. For purposes of illustration, the invention is described herein primarily in the context of LCD display devices having red, green, and blue pixel sub-components arranged in vertical stripes of same-colored pixel sub-components, as this is the type of display device that is currently most commonly used with portable computers. Moreover, the invention is not limited to use with display devices having vertical stripes or pixels with exactly three pixel sub-components. In general, the invention can be practiced with an LCD or another flat panel display device having any type of pixel/sub-component arrangements or having any number of pixel sub-components per pixel.

Figure 4A:
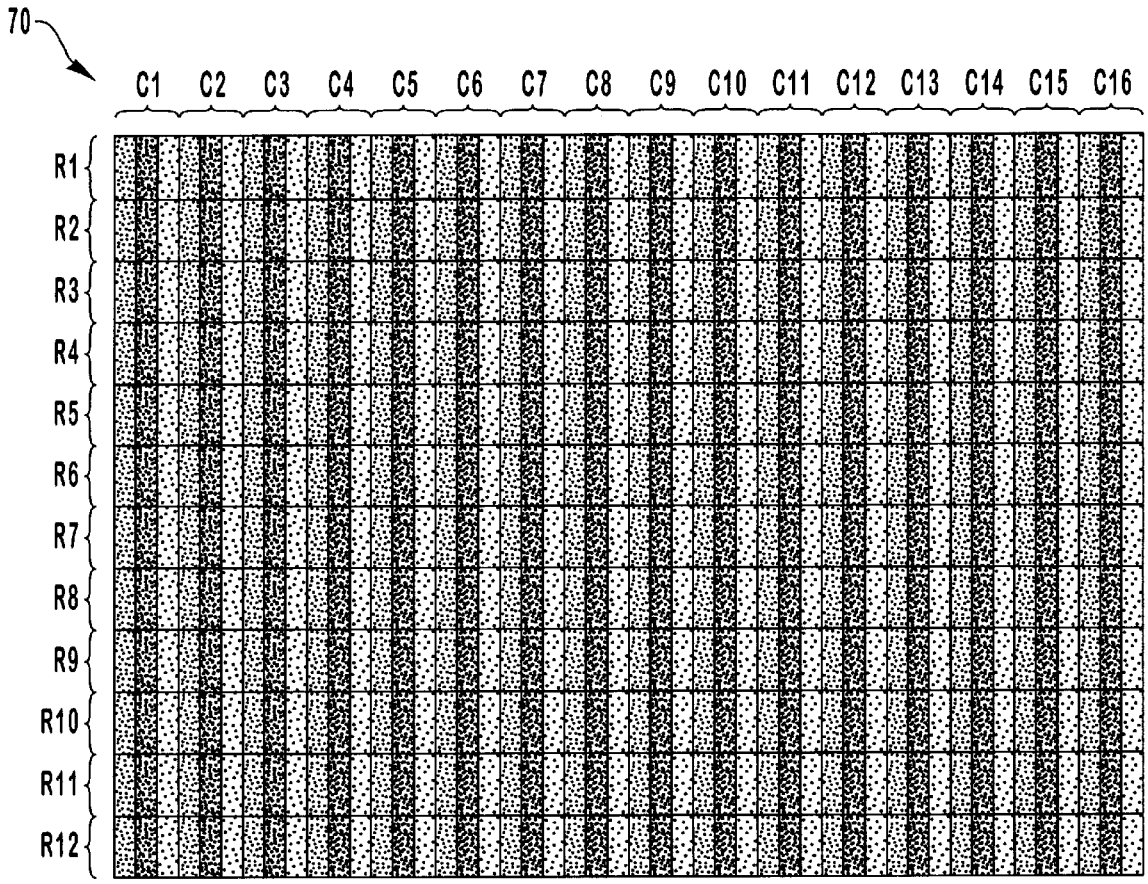
FIG. 4A illustrates an exemplary pixel/sub-component relationship of a flat panel display device.
Figure 4B:
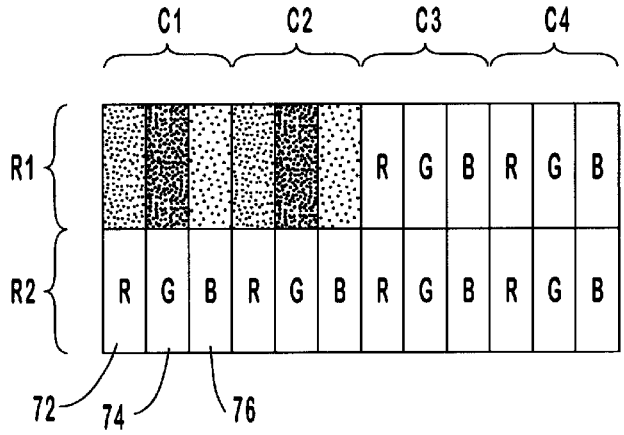
FIG. 4B provides greater detail of a portion of the exemplary pixel/sub-component relationship illustrated in FIG. 4A.

FIGS. 4A and 4B illustrate physical characteristics of an exemplary flat panel display device. In FIG. 4A, color LCD is illustrated as LCD 70 that includes a plurality of rows and a plurality of columns. The rows are labeled R1–R12 and the columns are labeled C1–C16. Color LCDs utilize multiple distinctly addressable elements and sub-elements, herein referred to respectively as pixels and pixel sub-components. FIG. 4B, which illustrates in greater detail the upper left hand portion of LCD 70, demonstrates the relationship between the pixels and pixel sub-components.

Each pixel includes three pixel sub-components, illustrated, respectively, as red (R) sub-component 72, green (G) sub-component 74 and blue (B) sub-component 76. The pixel sub-components are non-square and are arranged on LCD 70 to form vertical stripes of same-colored pixel sub-components. The RGB stripes normally run the entire length of the display in one direction. The resulting RGB stripes are sometimes referred to as "RGB striping." Common flat panel display devices used for computer applications that are wider than they are tall tend to have RGB stripes running in the vertical direction, as illustrated by LCD 70. This is referred to as "vertical striping." Examples of such devices that are wider than they are tall have column-to-row ratios, such as 640×480, 800×600, or 1024×768.

Flat panel display devices are also manufactured with pixel sub-components arranged in other patterns, including, for example, horizontal striping, zigzag patterns or delta patterns. The present invention can be used with such pixel sub-component arrangements. These other pixel sub-component arrangements generally also form stripes on the display device, although the stripes may not include only same-colored pixel sub-components. Stripes that contain differently-colored pixel sub-components are those that have pixel sub-components that are not all of a single color. One example of stripes that contain differently-colored pixel sub-components is found on display devices having patterns of color multiples that change from row to row (e.g., the first row repeating the pattern RGB and the second row repeating the reverse pattern BGR). "Stripes" are defined generally herein as running in the direction parallel to the long axis of non-square pixel sub-components or along lines of same-colored pixels, whichever is applicable to particular display devices.

A set of RGB pixel sub-components makes up a pixel. Therefore, by way of example, the set of pixel sub-components 72, 74, and 76 of FIG. 4B forms a single pixel. In other words, the intersection of a row and column, such as the intersection of row R2 and column C1, represents one pixel, namely (R2, C1). Moreover, each pixel sub-component 72, 74 and 76 is one-third, or approximately one-third, the width of a pixel while being equal, or approximately equal, in height to the height of a pixel. Thus, the three pixel sub-components 72, 74 and 76 combine to form a single substantially square pixel. This pixel/sub-component relationship can be utilized for rendering text images on a display device, as will be further explained below.

II. Image Data Processing and Image Rendering Operations

Figures 5, 6:
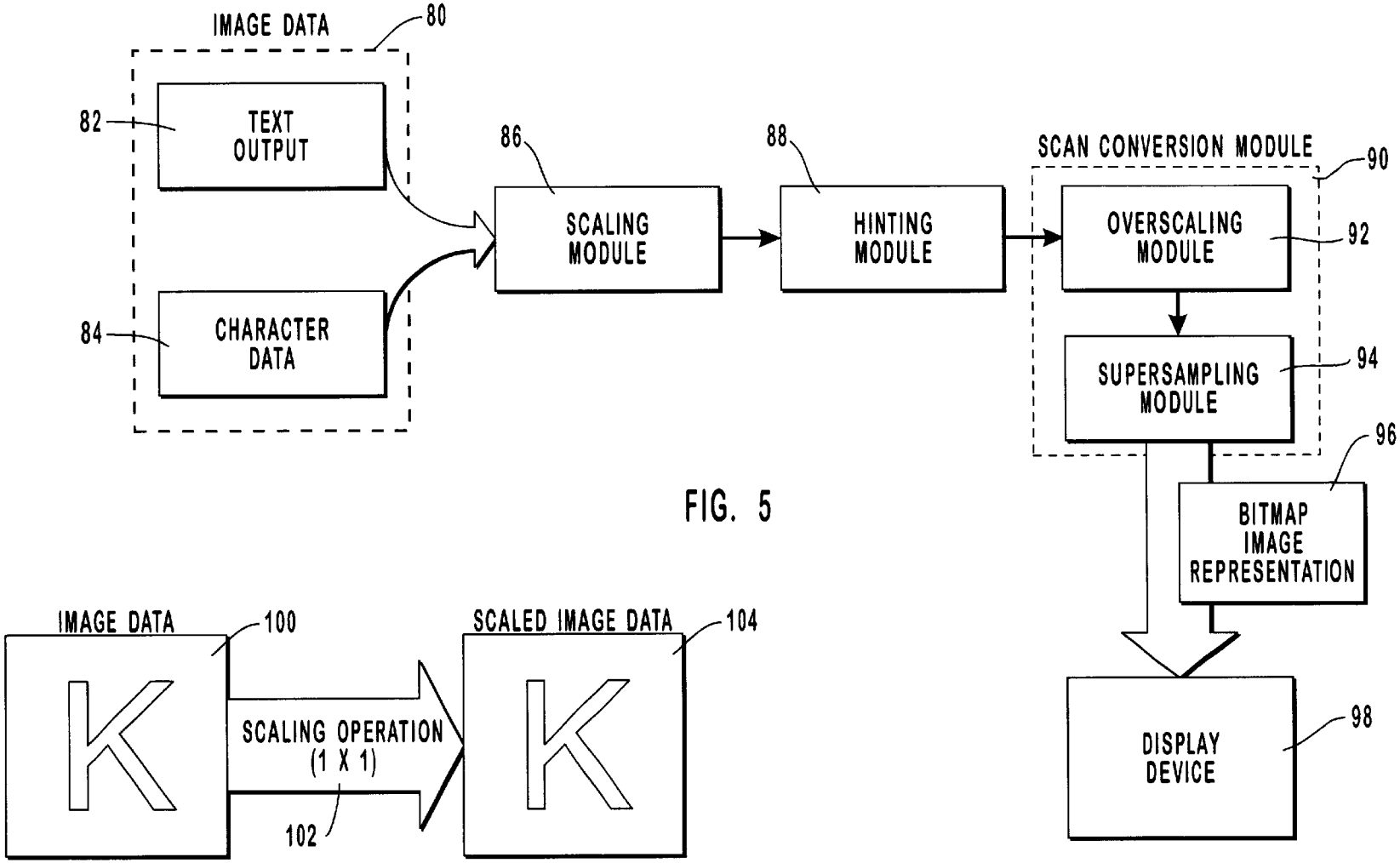
FIG. 5 provides a block diagram that illustrates an exemplary method for rendering images on a display device of a computer system.
FIG. 6 provides an example of a scaling operation for scaling image data.

In order to describe the image data processing and image rendering operations of the invention, reference is now made to FIG. 5, which is a high-level block diagram illustrating the scaling, hinting, and scan conversion operations. One of the objectives of the image data processing and image rendering operations is to obtain enough samples to enable each pixel sub-component to represent a separate portion of the image data, as will be further explained below.

In the diagram of FIG. 5, image data 80 represents text characters, one or more graphical images, or any other image, and includes two components. The first component is a text output component, illustrated as text output 82, which is obtained from an application program, such as a word processor program, and includes, by way of example, information identifying the characters, the font, and the point size that are to be displayed. The second component of the image data is a character data component, illustrated as character data 84, and includes information that provides a high-resolution digital representation of one or more sets of characters that can be stored in memory for use during text generation, such as vector graphics, lines, points and curves.

Image data 80 is manipulated by a series of modules, as illustrated in FIG. 5. For purposes of providing an explanation of how each module affects the image data, the following example, corresponding to FIGS. 6–9, is described in reference to image data that is represented as an upper-case letter "K", as illustrated by image data 100 of FIG. 6.

As will be described in greater detail below, the image data is at least partially scaled in an overscaling module 92 after the image data has been hinted according to the invention, as opposed to being fully scaled by scaling module 86 prior to the hinting operation. The scaling of the image data is performed so that the supersampling module 94 can obtain the desired number of samples that enable different portions of the image to be mapped to individual pixel sub-components. Fully scaling the image data in scaling module 86 prior to hinting would often adequately prepare the image data for the supersampling. However, it has been found that performing the full scaling on conventional fonts prior to hinting in conjunction with the sub-pixel precision rendering processes of the invention can induce drastic distortions of the font outlines during the hinting operation. For example, font distortions during hinting can be experienced in connection with characters that have oblique segments that are neither horizontal nor vertical, such as the strokes of "K" that extend from the vertical stem. Applying full scaling to such characters prior to hinting results in the oblique segments having orientations that are nearly horizontal. In an effort to preserve the width of such strokes during hinting, the coordinates of the points on the strokes can be radically altered, such that the character is distorted. In general, font distortions can be experienced in fonts that were not designed to be compatible with scaling by different factors in the horizontal and vertical directions prior to the hinting operation.

It has been found that performing the hinting operation prior to the full scaling of characters in accordance with the present invention eliminates such font distortions. In some embodiments, partial scaling of the image data can be performed prior to hinting, with the remainder being performed after hinting. In other implementations of the invention, only trivial scaling (i.e., scaling by a factor of one) is performed prior to hinting, with the full scaling being executed by overscaling module 92.

In addition, as will also be described in detail below, hinting operations in which selected points of the image data are rounded to positions that have fractional components with respect to the pixel boundaries preserve high-frequency information in the image data that might otherwise be lost.

Returning now to the discussion of FIG. 5, a scaling operation is performed on the image data, as illustrated by scaling module 86. FIG. 6 illustrates one example of the scaling operation according to the present invention, depicted as scaling operation 102, where image data 100 is scaled by a factor of one in the directions perpendicular and parallel to the striping to produce scaled image data 104. In this embodiment, where the scaling factor is one and is performed in both directions, the scaling operation is trivial. Other examples of the scaling operation that are in accordance with the present invention are non>trivial. Such examples include scaling the image data in the directions perpendicular and parallel to the striping by a factor other than one, or alternatively scaling the image data by a factor in the direction perpendicular to the striping and by a different factor in the direction parallel to the striping. The objective of the scaling operation and subsequent hinting and scan conversion operations is to process the image data so that multiple samples can be obtained for each region that corresponds to a pixel, as will be explained below.

After the image data has been scaled according to scaling module 86 of FIG. 5, the scaled image data is hinted in accordance with hinting module 88. The objectives of the hinting operation include aligning key points (e.g. stem edges) of the scaled image data with selected positions on a pixel grid and preparing the image data for supersampling.

Figure 7A:
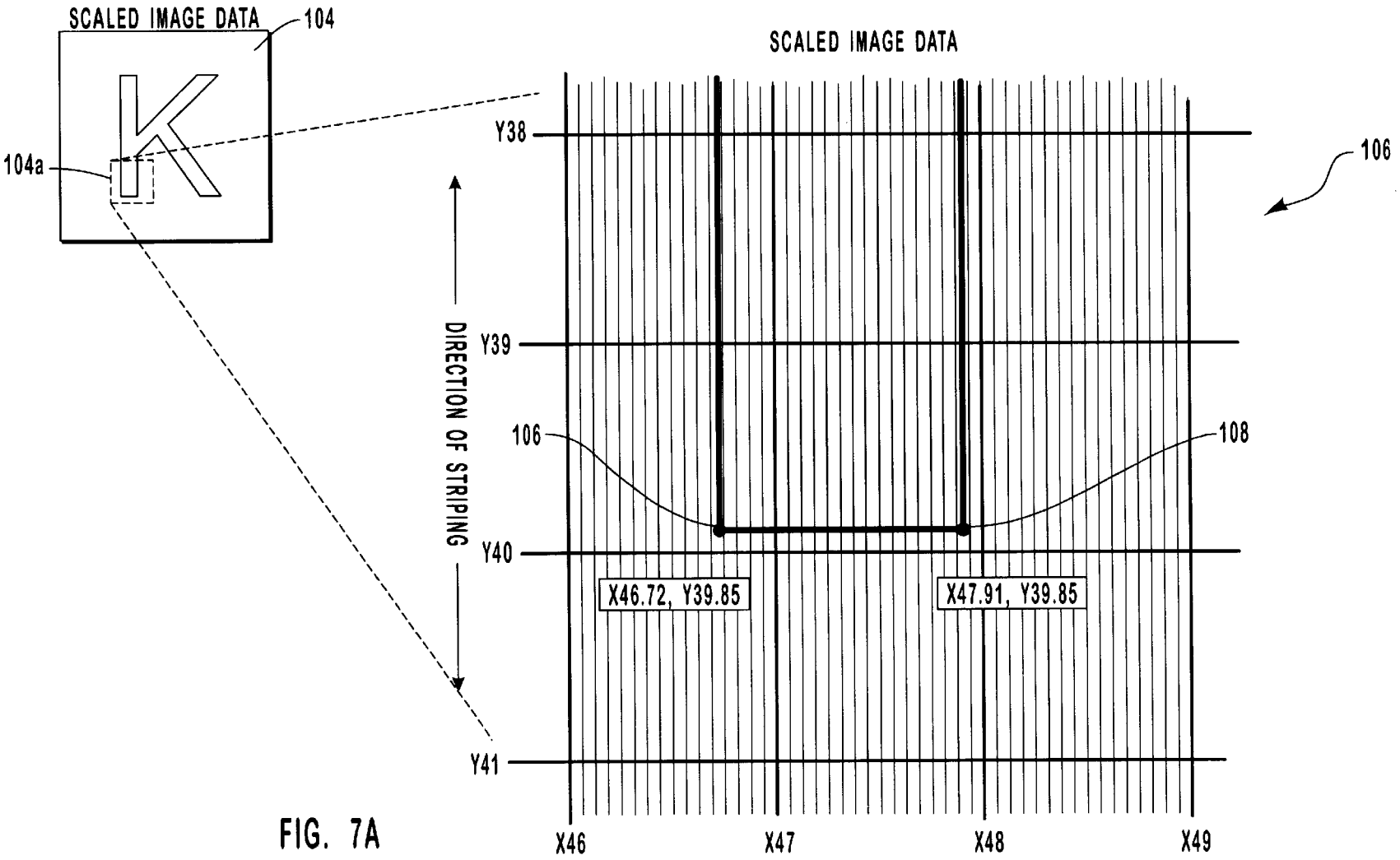
FIG. 7A provides an example of snapping the scaled image data to a grid.
Figure 7B:
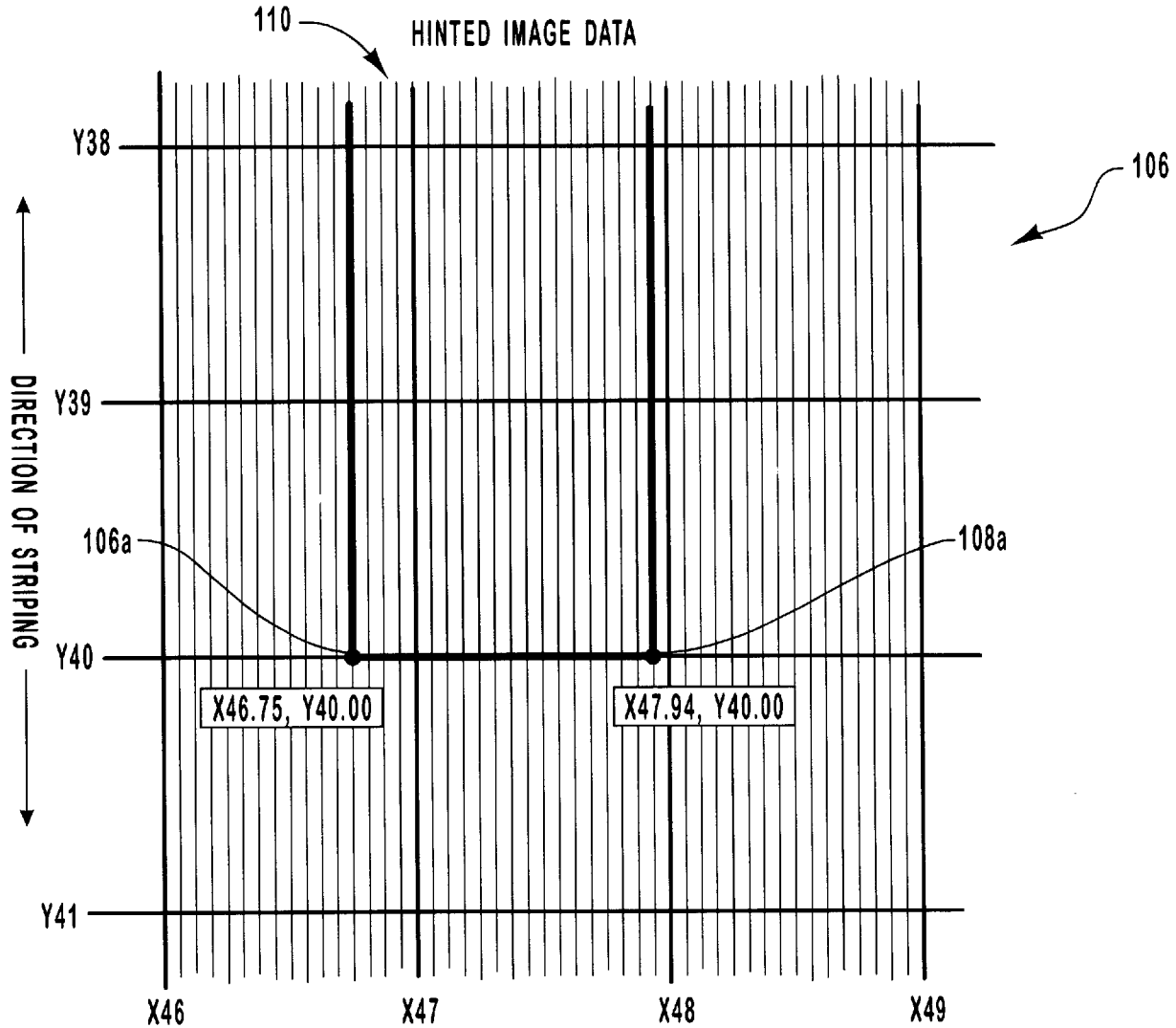
FIG. 7B provides an example of hinted image data produced from a hinting operation.

FIGS. 7A and 7B provide an example of the hinting operation. Referring first to FIG. 7A, and with reference to an embodiment where vertical striping is employed, a portion of grid 106 is illustrated, which includes primary horizontal boundaries Y38–Y41 that intersect primary vertical boundaries X46–X49. In this example, the primary boundaries correspond to pixel boundaries of the display device. The grid is further subdivided, in the direction perpendicular to the striping, by secondary boundaries to create equally spaced, fractional increments. The increments are fractional in the sense that they can fall on the grid at locations other than full pixel boundaries. By way of example, the embodiment illustrated in FIG. 7A includes secondary boundaries that subdivide the distance between the primary vertical boundaries into sixteen fractional increments. In other embodiments the number of fractional increments that are created can be greater or less than 16.

The scaled image data is placed on the grid, as illustrated in FIG. 7A by stem portion 104*a* of scaled image data 104 being superimposed on grid 106. The placing of the scaled image data does not always result in key points being properly aligned on the grid. By way of example, neither comer point 106 nor comer point 108 of the scaled image data are lined up on primary boundaries. Instead, the coordinates for corner points 106 and 108 are respectively (X46.72, Y39.85) and (X47.91, Y39.85) in this example.

As mentioned above, an objective of the hinting operation is to align key points with selected positions on a grid. Key points of the scaled image data are rounded to the nearest primary boundary in the direction parallel to the striping and to the nearest fractional increment in the direction perpendicular to the striping. As used herein, "key points" refers to points of the image data that have been selected for rounding to points on the grid as described herein. In contrast, other points of the image data can be adjusted, if needed, according to their positions relative to the key points using, for example, interpolation. Thus, according to the example illustrated in FIG. 7A, the hinting operation rounds the coordinates for comer point 106 to X46.75 (i.e., X46$^{12}/_{16}$) in the direction perpendicular to the striping and to Y40 in the direction parallel to the striping, as illustrated by comer point 106*a* of FIG. 7B. Similarly, the hinting operation rounds the coordinates for comer point 108 to X47.94 (i.e., X47$^{15}/_{16}$) in the direction perpendicular to the striping and to Y40 in the direction parallel to the striping, as illustrated by comer point 108*a* of FIG. 7B. Thus, the aligning of key points with selected positions of grid 106 is illustrated in FIG. 7B by the positions of comer points 106*a* and 108*a*, which represent the new locations for comer points 106 and 108 of FIG. 7A, as part of the hinted image data. Thus, the hinting operation includes placing the scaled image data on a grid that has grid points defined by the positions of the pixels of the display device, and rounding key points to the nearest primary boundary in the direction parallel to the striping and to the nearest fractional increment in the direction perpendicular to the striping, thereby resulting in hinted image data 110 of FIG. 7B.

After the hinting operation is performed by hinting module 88 of FIG. 5, the hinted image data is manipulated by scan conversion module 90, which includes two components: overscaling module 92 and supersampling module 94. The overscaling operation is performed first and includes scaling the hinted image data by an overscaling factor in the direction perpendicular to the striping. In general, the overscaling factor can be equivalent to the product generated by multiplying the denominator of the fractional positions of the grid and the factor in the direction perpendicular to the stripes used in the scaling operation. In the embodiments wherein the scaling factor in the direction perpendicular to the stripes has a value of one, as is the case in the example illustrated in the accompanying drawings, the overscaling factor is simply equal to the denominator of the fractional positions of the grid, as described above in reference to the hinting operation.

Figure 8:
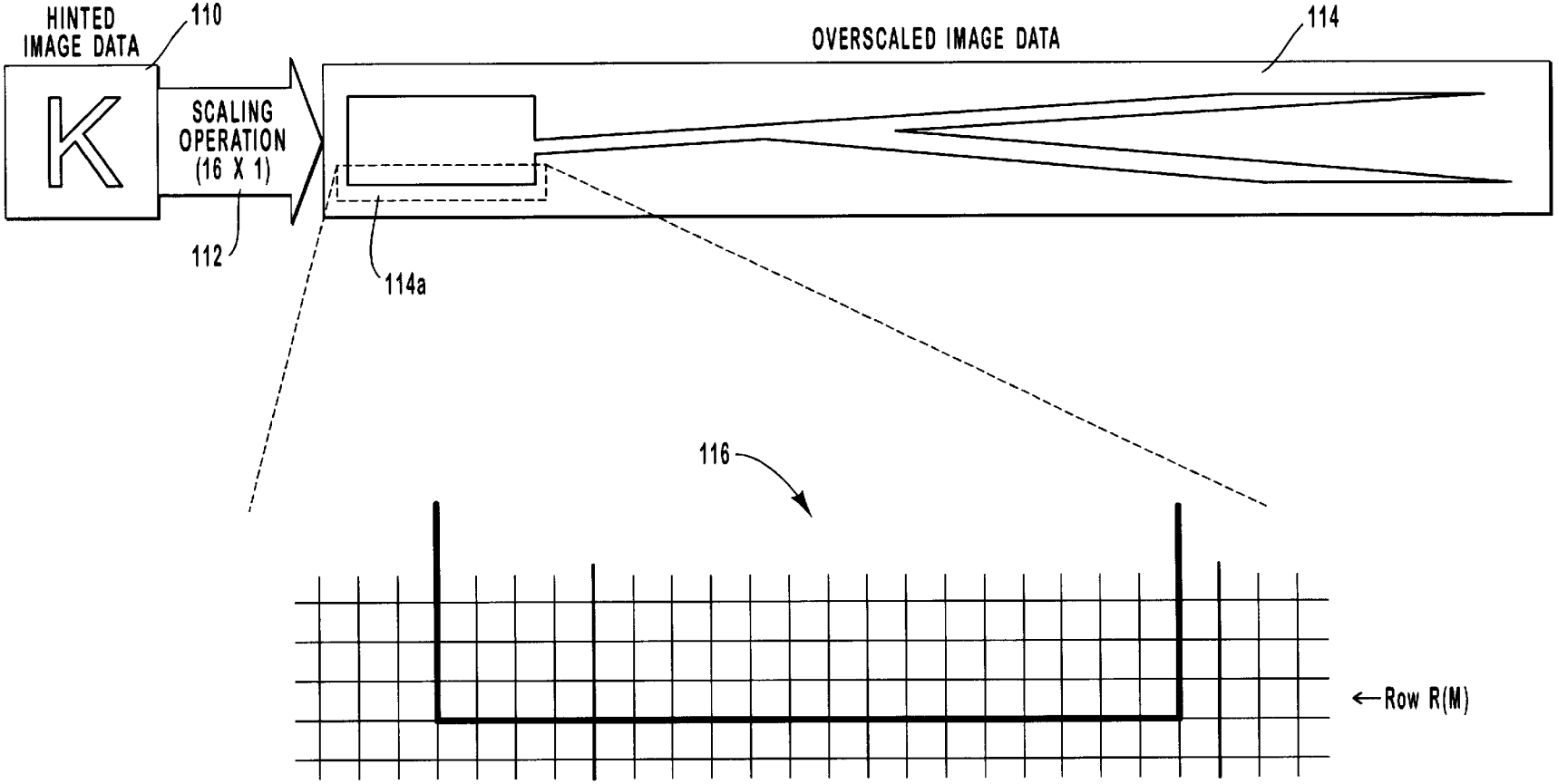
FIG. 8 provides an example of obtaining overscaling image data from an oversealing operation.

Thus, in reference to the present example, FIG. 8 illustrates hinted image data 110, obtained from the hinting operation, which undergoes scaling operation 112 to produce overscaled image data 114. Regarding scaling operation 112, the fractional increments created in the hinting operation of the present example were $^{1}/_{16th}$ the width of a full pixel and, therefore, scaling operation 112 scales hinted image data 110 by an overscaling factor of 16 in the direction perpendicular to the striping.

One result of the overscaling operation is that the fractional positions developed in the hinting operation become whole numbers. This is illustrated in FIG. 8 by stem portion 114*a*, of overscaled image data 114, being projected onto grid 116. In other words, the overscaling operation results in image data that has 16 increments or samples for each full pixel width, with each increment being designated as having an integer width.

Once the overscaling operation has been performed according to overscaling module 92 of FIG. 5, supersampling module 94 performs a supersampling operation. To illustrate the supersampling operation, Row R(M) of grid 116 of FIG. 8, which includes a part of stem portion 114*a*, is further examined in FIG. 9. As mentioned above, 16 samples have been generated for each full pixel. In the supersampling operation, the samples are mapped to pixel sub-components.

The supersampling operations disclosed herein represent examples of "displaced sampling", wherein samples are mapped to individual pixel sub-components, which may be displaced from the center of the full pixels (as is the case for the red and blue pixel sub-components in the examples specifically disclosed herein). Furthermore, the samples can be generated and mapped to individual pixel sub-components at any desired ratio. In other words, different numbers of samples and multiple samples can be mapped to any of the multiple pixel sub-components in a full pixel. The process of mapping sets of samples to pixel sub-components can be understood as a filtering process. The filters correspond to the position and number of samples included in the sets of samples mapped to the individual pixel sub-components. Filters corresponding to different colors of pixel sub-components can have the same size or different sizes. The samples included in the filters can be mutually exclusive (e.g., each samples is passed through only one filter) or the filters can overlap (e.g., some samples are included in more than one filter). The size and relative position of the filters used to selectively map spatially different sets of one or more samples to the individual pixel sub-components of a pixel can be selected in order to reduce color distortion or errors that can sometimes be experienced with displaced sampling.

The filtering approach and the corresponding mapping process can be as simple as mapping samples to individual pixel sub-components on a one-to-one basis, resulting in a mapping ratio of 1:1:1, expressed in terms of the number of samples mapped to the red, green, and blue pixel sub-components of a given full pixel. The filtering and corresponding mapping ratios can be more complex. Indeed, the filters can overlap, such that some samples are mapped to more than one pixel sub-component. Further information relating to scan conversion operations, filtering, and mapping ratios that can be used in conjunction with the invention are disclosed in U.S. Pat. No. 6,188,385, issue Feb. 13, 2001, entitled "Methods and Apparatus for Performing Image Rendering and Rasterization Operations," which is incorporated herein by reference.

Figure 9:
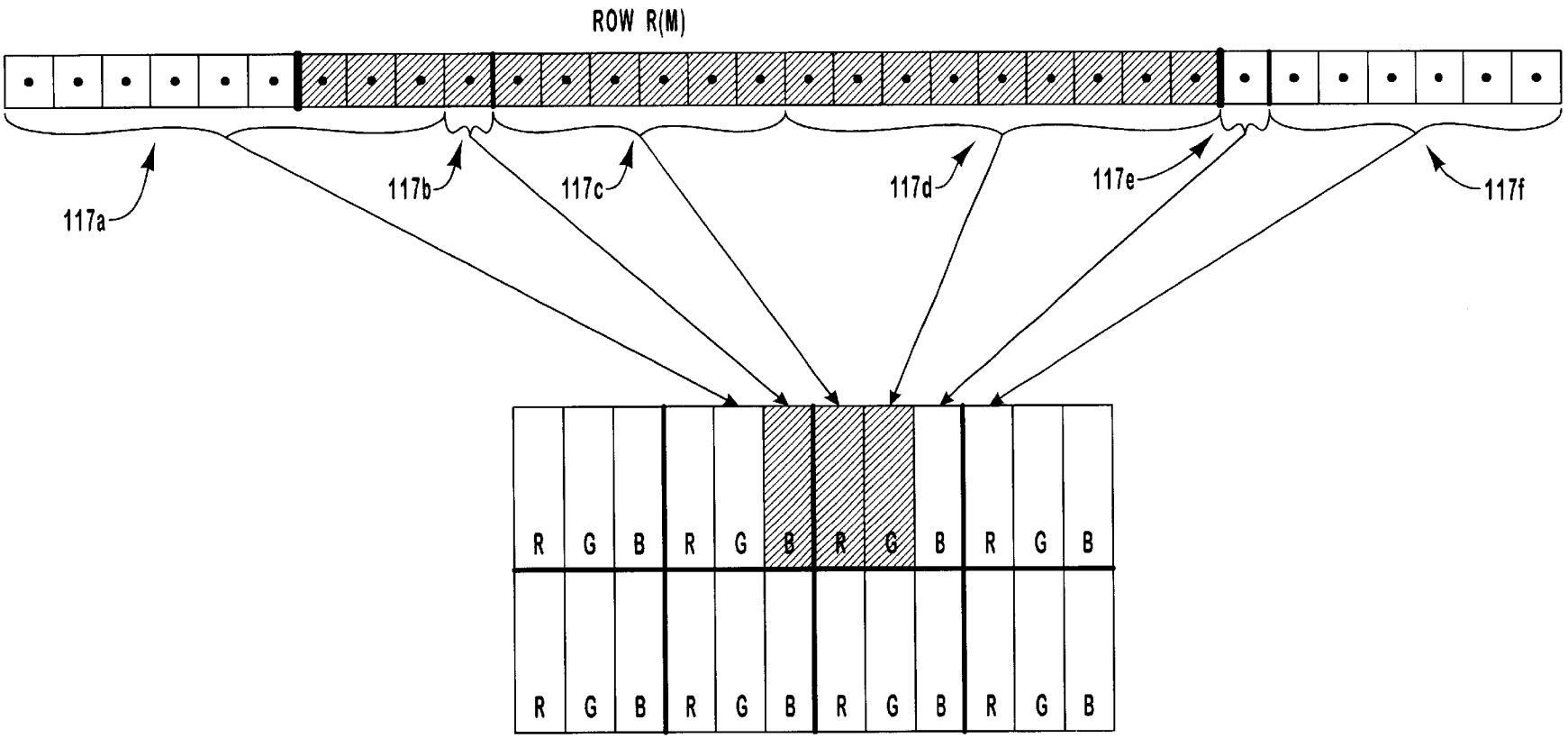
FIG. 9 provides an example of supersampling image data and mapping the data to pixel sub-components.

In the example of FIG. 9, the filters are mutually exclusive and result in a mapping ratio of 6:9:1, although other ratios such as 5:9:2 can be used to establish a desired color filtering regime. The mapping ratio is 6:9:1 in the illustrated example in the sense that when samples are taken, 6 samples are mapped to a red pixel sub-component, 9 samples are mapped to a green pixel sub-component, and one sample is mapped to a blue pixel sub-component, as illustrated in FIG. 9. The samples are used to generate the luminous intensity values for each of the three pixel sub-components. When the image data is black text on a white background, this means selecting the pixel sub-components as being on, off, or having some intermediate luminous intensity value. For example, of the nine samples shown at 117*a*, six fall outside the outline of the character. The six samples outside the outline contribute to the white background color, whereas the three samples inside the outline contribute to the black foreground color. As a result, the green pixel sub-component corresponding to the set of samples 117*a* is assigned a luminous intensity value of approximately 66.67% of the full available green intensity in accordance with the proportion of the number of samples that contribute to the background color relative to the number that contribute to the foreground color.

Sets of samples 117*b*, 117*c*, and 117*d* include samples that fall within the outline of the character and correspond to the black foreground color. As a result, the blue, red, and green pixel sub-components associated with sets 117*b*, 117*c*, and 117*d*, respectively, are given a luminous intensity value of 0%, which is the value that contributes to the perception of the black foreground color. Finally, sets of samples 117*e* and 117*f* fall outside the outline of the character. Thus, the corresponding blue and red pixel sub-components are given luminous intensity values of 100%, which represent full blue and red intensities and also represent the blue and red luminous intensities that contribute to the perception of the white background color. This mapping of the samples to corresponding pixel sub-components generates a bitmap image representation of the image data, as provided in FIG. 5 by bitmap image representation 96 for display on display device 98.

Thus, a primary objective of the scaling operation, the hinting operation, and initial stages of the scan conversion operation is to process the data so that multiple samples can be obtained for each region of the image data that corresponds to a full pixel. In the embodiment that has been described in reference to the accompanying drawings, the image data is scaled by a factor of one, hinted to align key points of the image data with selected positions of a pixel grid, and scaled by an overscaling factor that equals the denominator of the fractional increments of the grid.

Alternatively, the invention can involve scaling in the direction perpendicular to the stripes by a factor other than one, coupled with the denominator of the fractional positions of the grid points and, consequently, the overscaling factor, being modified by a corresponding amount. In other words, the scaling factor and the denominator can be selected such that the multiplication product of the scaling factor and the denominator equals the number of samples to be generated for each region of the image data that corresponds to a single full pixel (i.e., the supersampling rate). By way of example, if the supersampling rate is 16, the scaling operation can involve scaling by a factor of two in the direction perpendicular to the stripes, rounding to grid points at ⅛ of the full pixel positions, and overscaling in the scan conversion process at a rate of 8. In this manner, the image data is prepared for the supersampling operation and the desired number of samples are generated for each region of the image data that corresponds to a single full pixel.

III. Exemplary Software Embodiments

FIG. 2, which has been previously discussed in detail, illustrates an exemplary system that provides a suitable operating environment for the present invention. In FIG. 2, computer 20 includes video adapter 48 and system memory 22, which further includes random access memory (RAM) 25. Operating system 35 and one or more application programs 36 can be stored on RAM 25. Data used for the displaying of image data on a display device is sent from system memory 22 to video adapter 48, for the display of the image data on monitor 47.

Figure 10A:
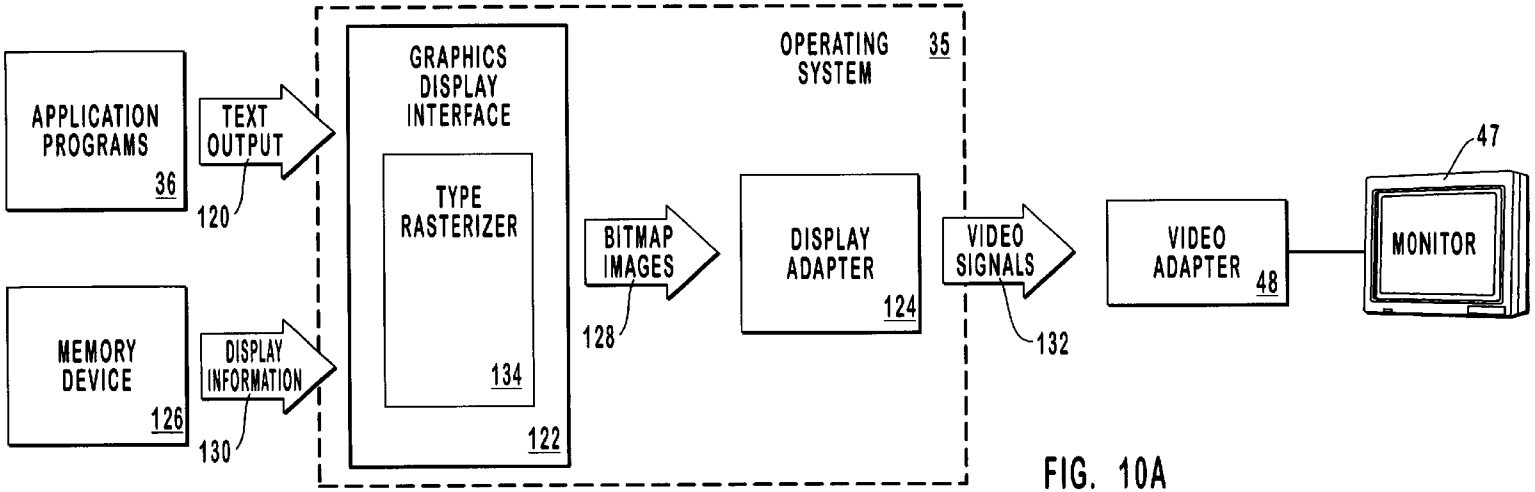
FIG. 10A provides an exemplary method for rendering text images on a display device of a computer system.
Figure 10B:
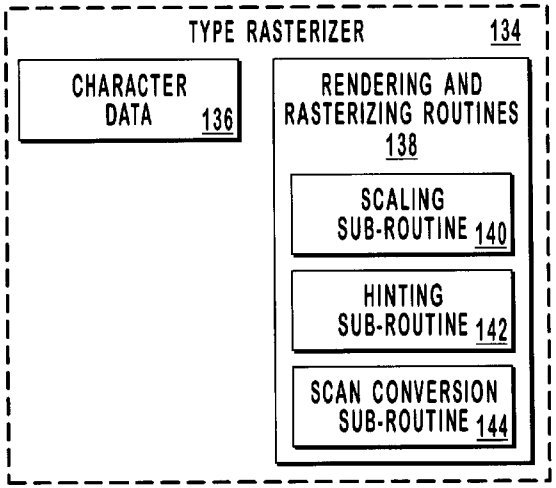
FIG. 10B provides a more detailed illustration of the type rasterizer of FIG. 10A.
Figure 11:
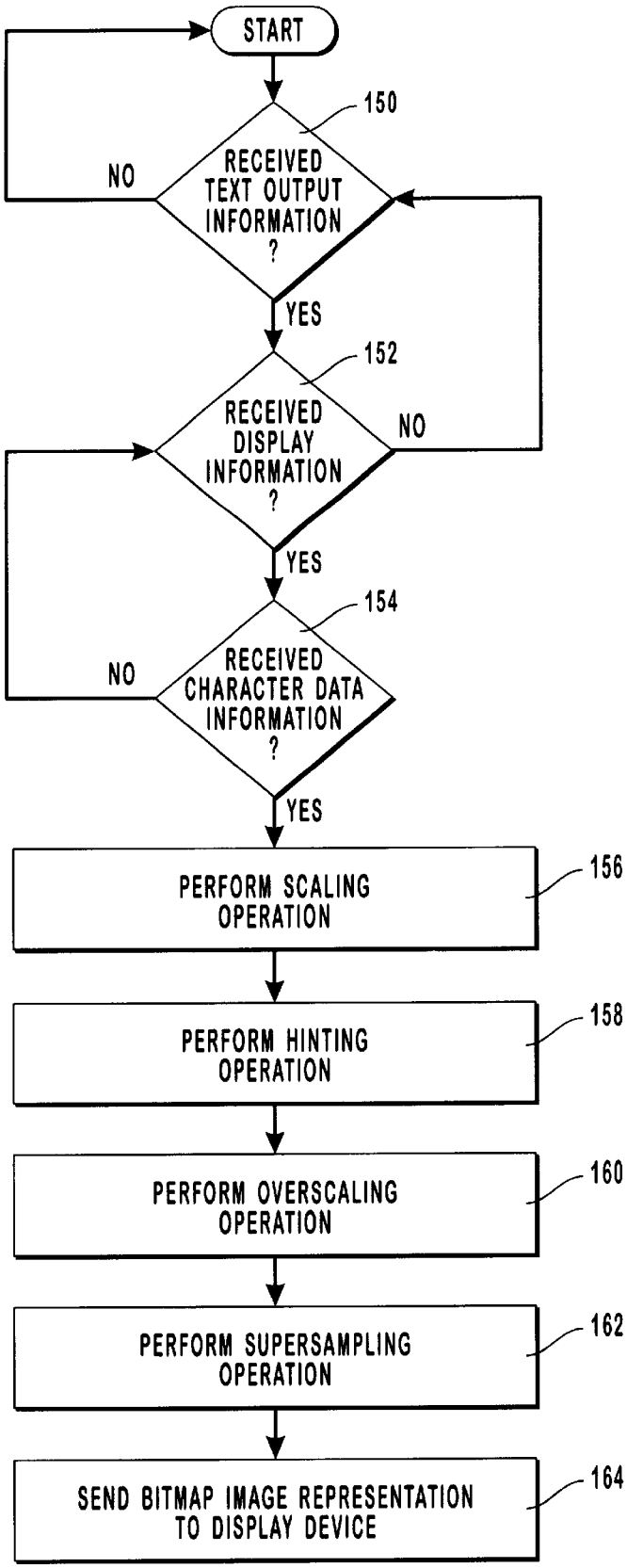
FIG. 11 provides a flow chart that illustrates an exemplary method for rendering and rasterizing image data for display according to an embodiment of the present invention.

In order to describe exemplary software embodiments for displaying image data in accordance with the present invention, reference is now made to FIGS. 10A, 10B, and 11. In FIGS. 10A and 10B an exemplary method is illustrated for rendering image data, such as text, on a display device according to the present invention. FIG. 11 provides a flow chart for implementing the exemplary method of FIGS. 10A and 10B.

In FIG. 10A, application programs 36, operating system 35, video adapter 48 and monitor 47 are illustrated. An application program can be a set of instructions for generating a response by a computer. One such application program is, by way of example, a word processor. Computer responses that are generated by the instructions encoded in a word processor program include displaying text on a display device. Therefore, and as illustrated in FIG. 10A, the one or more application programs 36 can include a text output sub-component that is responsible for outputting text information to operating system 35, as illustrated by text output 120.

Operating system 35 includes various components responsible for controlling the display of image data, such as text, on a display device. These components include graphics display interface 122, and display adapter 124 Graphics display interface 122 receives text output 120 and display information 130. As explained above, text output 120 is received from the one or more application programs 36 and includes, by way of example, information identifying the characters to be displayed, the font to be used, and the point size at which the characters are to be displayed. Display information 130 is information that has been stored in memory, such as in memory device 126, and includes, by way of example, information regarding the foreground and/or background color information. Display information 130 can also include information on scaling to be applied during the display of the image.

A type rasterizer component for processing text, such as type rasterizer 134, is included within graphics display interface 82 and is further illustrated in FIG. 10B. Type rasterizer 134 more specifically generates a bitmap representation of the image data and includes character data 136 and rendering and rasterization routines 138. Alternatively, type rasterizer 134 can be a module of one of the application programs 36 (e.g., part of a word processor).

Character data 136 includes information that provides a high-resolution digital representation of one or more sets of characters to be stored in memory for use during text generation. By way of example, character data 136 includes such information as vector graphics, lines, points and curves. In other embodiments, character data can reside in memory 126 as a separate data component rather than being bundled with type rasterizer 134. Therefore, implementation of the present exemplary method for rendering and rasterizing image data for display on a display device can include a type rasterizer, such as type rasterizer 134 receiving text output 120, display information 130 and character data 136, as further illustrated in the flowchart of FIG. 11. Decision block 150 determines whether or not text output 120 of FIG.

10A has been received from the one or more application programs 36. If text output 120 has not been received by graphics display interface 122, which in turn provides text output 120 to type rasterizer 134 of FIG. 10A, then execution returns back to start as illustrated in FIG. 11. Alternatively, if text output 120 is received by graphics display interface 122 and relayed to type rasterizer 134, then text output 120 is sent to rendering and rasterizing routines 138 within type rasterizer 134 of FIG. 10B.

Upon receipt of text output information 120, execution continues to decision block 152 of FIG. 11, which determines whether or not display information 130 of FIG. 10A has been received from memory, such as memory device 126 of FIG. 10A. If display information 130 has not been received by graphics display interface 122, which in turn provides display information 130 to type rasterizer 134 of FIG. 10A, execution waits by returning back to decision block 150. Alternatively, if display information 130 is received by graphics display interface 122 and relayed to type rasterizer 134, then display information 130 is sent to rendering and rasterizing routines 138 within type rasterizer 134 of FIG. 10B.

Upon receipt of display information 130, execution proceeds to decision block 154 for a determination as to whether or not character data 136 of FIG. 10B has been obtained. If character data 136 is not received by rendering and rasterizing routines 138, then execution waits by returning back to decision block 152. Once it is determined that text output 120, display information 130, and character data 136 have been received by rendering and rasterizing routines 138, then execution proceeds to step 156.

Referring back to FIG. 10B, rendering and rasterizing routines 138 include scaling sub-routine 140, hinting sub-routine 142, and scan conversion sub-routine 144, which are respectively referred to in the high-level block diagram of FIG. 5 as scaling module 86, hinting module 88, and scan conversion module 90. One primary objective of scaling sub-routine 140, hinting sub-routine 142, and the initial stages of scan conversion sub-routine 144 is to process the data so that multiple samples can be obtained for each region that corresponds to a pixel.

In step 156 of FIG. 11, a scaling operation is performed in the manner explained above in relation to scaling module 86 of FIG. 5. In the present exemplary method, the image data includes text output 120, display information 130, and character data 136. The image data is manipulated by scaling sub-routine 140 of FIG. 10B, which performs a scaling operation where, by way of example, the image data is scaled by a factor of one in the directions perpendicular and parallel to the striping to produce scaled image data. Other examples of the scaling operation that are in accordance with the present invention include scaling the image data in the directions perpendicular and parallel to the striping by a factor other than one, or alternatively scaling the image data by a factor in the direction perpendicular to the striping and by a different factor in the direction parallel to the striping.

Execution then proceeds to step 158, where a hinting operation is performed by hinting sub-routine 142 of FIG. 10B to the scaled image data in the manner explained above in relation to hinting module 88 of FIG. 5. The hinting operation includes placing the scaled image data on a grid that has grid points defined by the positions of the pixels of the display device, and rounding key points (e.g. stem edges) to the nearest primary boundary in the direction parallel to the striping and to the nearest fractional increment in the direction perpendicular to the striping, thereby resulting in hinted image data.

Execution then proceeds to step 160, where an overscaling operation is performed by scan conversion sub-routine 144 of FIG. 10B to the hinted image data in the manner explained above in relation to overscaling module 92 of FIG. 5. The overscaling operation includes scaling the hinted image data by an overscaling factor in the direction perpendicular to the striping. In one embodiment, the overscaling factor is equal to the denominator of the fractional increments developed in the hinting operation so that the fractional positions become whole numbers.

Execution then proceeds to step 162, where a supersampling operation is performed by scan conversion sub-routine 144 of FIG. 10B in the manner explained above in relation to supersampling module 94 of FIG. 5. In the supersampling operation, the samples are mapped to pixel sub-components. The samples are used to generate the luminous intensity values for each of the three pixel sub-components. This mapping of the samples to corresponding pixel sub-components generates a bitmap image representation of the image data.

Execution then proceeds to step 164, where the bitmap image representation is sent for display on the display device. Referring to FIG. 10A, the bitmap image representation is illustrated as bitmap images 128 and is sent from graphics display interface 122 to display adapter 124. In another embodiment, the bitmap image representation can be further processed to perform color processing operations and/or color adjustments to enhance image quality. In one embodiment, and as illustrated in FIG. 10A, display adapter 124 converts the bitmap image representation into video signals 132. The video signals are sent to video adapter 48 and formatted for display on a display device, such as monitor 47. Thus, according to the present invention, images are displayed with increased resolution on a display device, such as a flat panel display device, by utilizing an increased number of sampling points.

While the foregoing description of the present invention has disclosed embodiments where the image data to be displayed is text, the present invention also applies to graphics for reducing aliasing and increasing the effective resolution that can be achieved using flat panel display devices. In addition, the present invention also applies to the processing of images, such as for example scanned images, in preparing the images for display.

Furthermore, the present invention can be applied to grayscale monitors that use multiple non-square pixel sub-components of the same color to multiply the effective resolution in one dimension as compared to displays that use distinct RGB pixels. In such embodiments where gray scale techniques are utilized, as with the embodiments discussed above, the scan conversion operation involves independently mapping portions of the scaled hinted image into corresponding pixel sub-components to form a bitmap image. However, in gray scale embodiments, the intensity value assigned to a pixel sub-component is determined as a function of the portion of the scaled image area mapped into the pixel sub-component that is occupied by the scaled image to be displayed. For example, if, a pixel sub-component can be assigned an intensity value between 0 and 255, 0 being effectively off and 255 being full intensity, a scaled image segment (grid segment) that was 50% occupied by the image to be displayed would result in a pixel sub-component being assigned an intensity value of 127 as a result of mapping the scaled image segment into a corresponding pixel sub-component. In accordance with the present invention, the neighboring pixel sub-component of the same pixel would then have its intensity value independently determined as a function of another portion, e.g., segment, of the scaled image. Likewise, the present invention can be applied to printers, such as laser printers or ink jet printers, having non-square full pixels, an embodiment in which, for example, the supersampling operation 162 could be replaced by a simple sampling operation, whereby every sample generated corresponds to one non-square full pixel.

Therefore, the present invention relates to methods and systems for displaying images with increased resolution on a display device, such as a flat panel display device, by utilizing an increased number of sampling points. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed and desired to be secured by United States Letters Patent is:

1. In a computer having a display device on which images are displayed, the display device having a plurality of pixels each having a plurality of separately controllable pixel sub-components of different colors, the pixel sub-components forming stripes on the display device, a method of rasterizing image data in preparation for rendering an image on the display device, the method comprising the steps of:

scaling image data that is to be displayed on a display device by a first factor in the direction parallel to the stripes and by a second factor in the direction perpendicular to the stripes;

adjusting selected data points of the scaled image data to grid points on a grid defined by the pixels of the display device, at least some if the grid points having fractional positions on the grid in the direction perpendicular to the stripes;

scaling the hinted image data by an overscaling factor greater than one in the direction perpendicular to the stripes; and mapping spatially different sets of one or more samples of the image data to each of the pixel sub-components of the pixels.

2. A method as recited in claim 1, wherein the step of adjusting the selected data points comprises the act of rounding the selected points to grid points that:

correspond to the nearest full pixel boundaries in the direction parallel to the stripes; and correspond to the nearest fractional positions on the grid in the direction perpendicular to the stripes.

3. A method as recited in claim 1, wherein the first factor in the direction parallel to the stripes is one.

4. A method as recited in claim 3, wherein the second factor in the direction perpendicular to the stripes is one.

5. A method as recited in claim 1, wherein the overscaling factor is equivalent to the denominator of the fractional positions of the grid points.

6. A method as recited in claim 1, wherein the step of mapping comprises the act of sampling the image data to generate, for each region of the hinted image data that corresponds to a full pixel, a number of samples equivalent to said denominator.

7. A method as recited in claim 1, wherein the display device comprises a liquid crystal display.

8. A method as recited in claim 1, wherein the denominator of the fractional positions multiplied by the second factor perpendicular to the stripes produces a value equal to the number of samples generated for each region of the image data that corresponds to a full pixel.

9. A method as recited in claim 8, wherein the denominator has a value other than one and the second factor has a value other than one.

10. A method as recited in claim 1, further comprising the step of generating a separate luminous intensity value for each of the pixel sub-components based on the different sets of one or more samples mapped thereto.

11. A method as recited in claim 10, further comprising the step of displaying the image on the display device using the separate luminous intensity values, resulting in each of the pixel sub-components of the pixels, rather than the entire pixels, representing different portions of the image.

12. In a computer having a display device on which images are displayed, the display device having a plurality of pixels each having a plurality of separately controllable pixel sub-components of different colors, the pixel sub-components forming stripes on the display device, a method of rasterizing image data in preparation for rendering an image on the display device, the method comprising the acts of:

scaling image data that is to be displayed on a display device by a first factor in the direction parallel to the stripes and by a second factor in the direction perpendicular to the stripes;

rounding selected points of the scaled image data to grid points on a grid defined by the pixels of the display device, wherein the grid points:

correspond to a nearest full pixel boundaries in the direction parallel to the stripes; and correspond to a nearest fractional position on the grid in the direction perpendicular to the stripes, the fractional position having a selected denominator;

scaling the hinted image data by an overscaling factor greater than one in the direction perpendicular to the stripes that is equal to the denominator of the fractional positions; and generating, for each region of the image data that corresponds to a full pixel, a number of samples equal to the product generated by multiplying the second factor and the overscaling factor;

mapping spatially different subsets of the number of samples to each of the pixel sub-components of the full pixel.

13. A method as recited in claim 12, wherein the display device comprises a liquid crystal display.

14. A method as recited in claim 12, wherein each of the stripes formed on the display device consists of same-colored pixel sub-components.

15. A method as recited in claim 12, wherein each of the stripes formed on the display device consists of differently-colored pixel sub-components.

16. A method as recited in claim 12, wherein the second factor in the direction perpendicular to the stripes is one.

17. A method as recited in claim 12, wherein the second factor in the direction perpendicular to the stripes has a value other than one.

18. A computer program product for implementing a method for rasterizing image data in preparation for rendering an image on a display device, the display device having a plurality of pixels each having a plurality of separately controllable pixel sub-components of different colors, the pixel sub-components forming stripes on the display device, the computer program product comprising:

a computer-readable medium having computer-executable instructions for executing the steps of:

scaling image data that is to be displayed on a display device by a first factor in the direction parallel to the stripes and by a second factor in the direction perpendicular to the stripes;

adjusting selected data points of the scaled image data to grid points on a grid defined by the pixels of the display device, at least some of the grid points having fractional positions on the grid in the direction perpendicular to the stripes;

scaling the hinted image data by an overscaling factor greater than one in the direction perpendicular to the stripes; and mapping spatially different sets of one or more samples of the image data to each of the pixel sub-components of the pixels.

19. A computer program product as recited in claim 18, wherein the step of adjusting the selected data points comprises the act of rounding the selected points to grid points that:

correspond to the nearest full pixel boundaries in the direction parallel to the stripes; and correspond to the nearest fractional positions on the grid in the direction perpendicular to the stripes.

20. A computer program product as recited in claim 18, wherein the second factor in the direction perpendicular to the stripes is one.

21. A computer program product as recited in claim 18, wherein the overscaling factor is equivalent to the denominator of the fractional positions of the grid points.

22. A computer program product as recited in claim 18, wherein the step of mapping comprises the act of sampling the image data to generate, for each region of the hinted image data that corresponds to a full pixel, a number of samples equivalent to said denominator.

23. A computer program product as recited in claim 18, wherein the denominator of the fractional positions multiplied by the second factor perpendicular to the stripes produces a value equal to the number of samples generated for each region of the image data that corresponds to a full pixel.

24. A computer program product as recited in claim 23, wherein the denominator has a value other than one and the second factor has a value other than one.

25. A computer system comprising:

a processing unit;

a display device having a plurality of pixels each having a plurality of separately controllable pixel sub-components of different colors, the pixel sub-components forming stripes on the display device; and a computer program product including a computer-readable medium carrying instructions that, when executed, enable the computer system to implement a method of rasterizing image data in preparation for rendering an image on the display device, the method comprising the steps of:

scaling image data that is to be displayed on a display device by a first factor in the direction parallel to the stripes and by a second factor in the direction perpendicular to the stripes;

adjusting selected data points of the scaled image data to grid points on a grid defined by the pixels of the display device, at least some of the grid points having fractional positions on the grid in the direction perpendicular to the stripes;

scaling the hinted image data by an overscaling factor greater than one in the direction perpendicular to the stripes; and mapping spatially different sets of one or more samples of the image data to each of the pixel sub-components of the pixels.

26. A computer system as recited in claim 25, wherein the first factor and second factor are equal.

27. A computer system as recited in claim 25, wherein the step of adjusting the selected data points comprises the act of rounding the selected points to grid points that:

correspond to the nearest fill pixel boundaries in the direction parallel to the stripes; and correspond to the nearest fractional positions on the grid in the direction perpendicular to the stripes.

28. A computer system as recited in claim 25, wherein the overscaling factor is equivalent to the denominator of the fractional positions of the grid points.

29. A computer system as recited in claim 25, wherein the step of mapping comprises the act of sampling the image data to generate, for each region of the hinted image data that corresponds to a fill pixel, a number of samples equivalent to said denominator.

30. A computer system as recited in claim 25, wherein the display device comprises a liquid crystal display.

31. A computer system as recited in claim 25, wherein each of the stripes formed on the display device consists of same-colored pixel sub-components.

32. A computer system as recited in claim 25, wherein each of the stripes formed on the display device consists of differently-colored pixel sub-components.

33. A computer system as recited in claim 25, wherein the denominator of the fractional positions multiplied by the second factor perpendicular to the stripes produces a value equal to the number of samples generated for each region of the image data that corresponds to a full pixel.

* * * * *

UNITED STATES PATENT AND TRADEMARK OFFICE

CERTIFICATE OF CORRECTION

PATENT NO. : 6,356,278
DATED : March 12, 2002
INVENTOR(S) : Beat Stamm, Gregory Hitchcock and Claude Betrisey It is certified that error appears in the above-identified patent and that said Letters Patent is hereby corrected as shown below:

Column 10,
Line 42, after "are" change "non>trivial" to -- non-trivial --

Column 11,
Line 13, before "point" change "comer" to -- corner --
Line 13, after "nor" change "comer" to -- corner --
Line 29, after "for" change "comer" to -- corner --
Line 31, after "by" change "comer" to -- corner --
Line 33, after "for" change "comer" to -- corner --
Line 36, before "point" change "comer" to -- corner --
Line 38, after "of" change "comer" to -- corner --
Line 39, after "for" change "comer" to -- corner --

Column 17,
Line 36, after "some" change "if" to -- of --

Column 20,
Line 36, after "to a" change "fill" to -- full --

Signed and Sealed this

Twenty-first Day of May, 2002

*Attest:*

*Attesting Officer*

JAMES E. ROGAN
*Director of the United States Patent and Trademark Office*